United States Patent [19]

Hernández

[11] 4,261,030

[45] Apr. 7, 1981

[54] WRAP-AROUND PARABOLIC LIGHT FIXTURE AND METHOD FOR MANUFACTURE

[75] Inventor: José A. Hernández, San Marcos, Tex.

[73] Assignee: Esquire, Inc., New York, N.Y.

[21] Appl. No.: 21,269

[22] Filed: Mar. 15, 1979

[51] Int. Cl.[3] ..... F21V 7/00

[52] U.S. Cl. ..... 362/296; 362/217; 362/263; 362/347; 113/116 J

[58] Field of Search ..... 362/217, 260, 263, 296, 362/297, 302, 346, 347, 349; 113/116 J

[56] References Cited

U.S. PATENT DOCUMENTS

| | | | |
|---|---|---|---|
| 2,758,199 | 8/1956 | Yonkens | 113/116 J |
| 4,027,151 | 5/1977 | Barthel | 362/217 |

*Primary Examiner*—Donald P. Walsh

*Attorney, Agent, or Firm*—Frank S. Vaden, III

[57] ABSTRACT

An improved light fixture for housing an elongated lamp and method for making same, the fixture having an elongated housing constructed from a continuous rectangular piece of sheet metal having four parallel bends therein forming planar side walls. The planar side walls form flange planes suitable for mating within grooves formed in suitable end pieces for the housing. The closure lens completes the housing. The construction of the elongated housing side walls is such that a reflector sheet when curvedly affixed to the two outermost planar side walls is tangential to the inner three planar side walls, thereby providing a parabolic reflecting surface for a lamp mounted within the reflector sheet. Two end wall reflectors, preferably one of which is directionally adjustable, also reflect luminous flux from the lamp. An adjustable light support for the non-electrical end of the elongated lamp, along with the adjustable end wall reflector, conveniently allows the improved light fixture to accept various sized elongated lamps without substantial loss of light reflecting capabilities.

22 Claims, 5 Drawing Figures

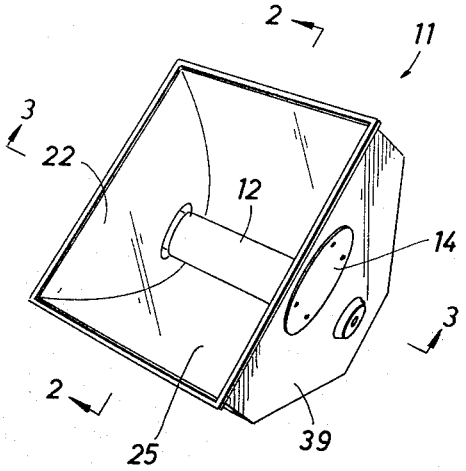
FIG. 1
FIG. 3
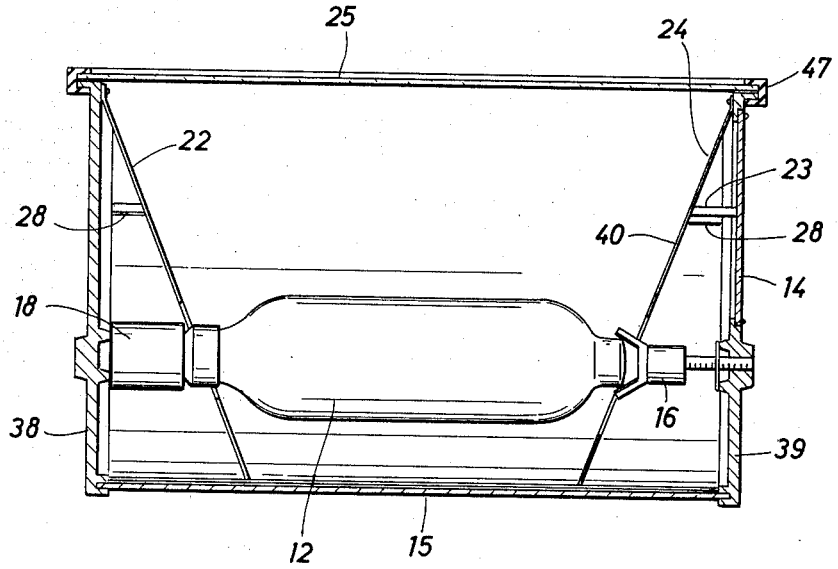
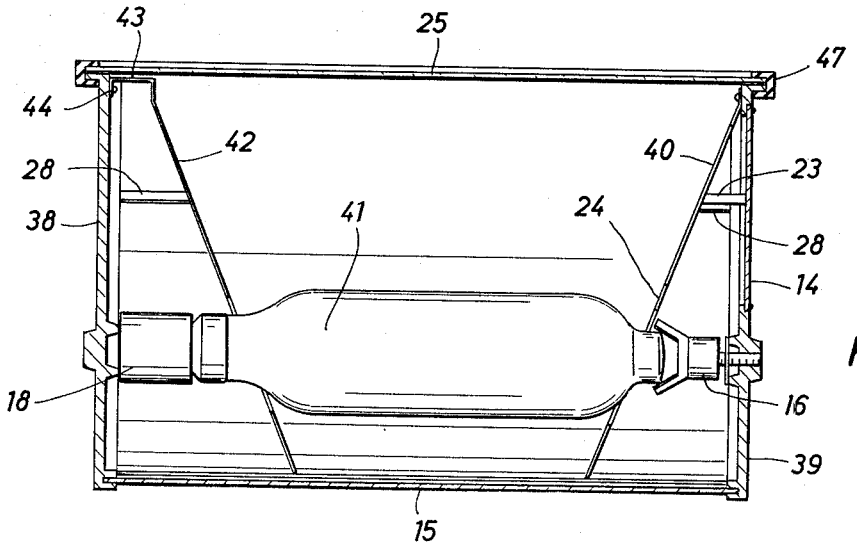
FIG. 4

WRAP-AROUND PARABOLIC LIGHT FIXTURE AND METHOD FOR MANUFACTURE

BACKGROUND OF THE INVENTION

1. Field of the Invention

This invention pertains to a lighting fixture and method of making the same and more particularly to a lighting fixture with an elongated housing accommodating and holding a reflector sheet in a manner such that light is parabolically or otherwise similarly advantageously reflected therefrom.

2. Description of the Prior Art

Light fixture housings and their light reflector systems used in conjunction with high intensity, gaseous discharge (HID) lamps are generally relatively complex structures. Reflectors used in such structures are preferably curvilinear so as to parabolically or otherwise advantageously reflect light from the fixture. Many fixtures include reflectors having multiple curved segments or segments which are complexedly curved with respect to one or more axes or focal points.

The housings enclosing such reflector systems are usually cast or molded to accept the various reflector segments, which are subsequently welded or bolted into place.

The set-up and production costs for such fixtures are expensive since special tooling is required and relatively skilled labor must be employed to ensure that the fixtures are properly made and assembled to produce the type of reflections which the fixtures were designed to produce.

It is well known that sheet metal, even relatively heavy sheet metal, is cheaper as a housing structure than a comparable cast structure. But, because of the complex reflector systems heretofore required in order to produce the light efficiencies expected of HID lamps, it has been assumed that sheet metal could not be extensively used in the construction of light fixture housings for HID lamps.

Therefore, it is a feature of the present invention to provide an improved light reflector system, achieving high lighting efficiencies, which is compatible with the construction of a housing therefor primarily from sheet metal.

It is another feature of the present invention to provide an improved light reflector system, the principal piece being a simple, flexible flat sheet, which assumes a parabolic shape when snapped into position.

It is still another feature of the present invention to provide an improved HID light reflector comprising housing and reflector components which are readily made mostly from flat sheet metal parts of simple shape and which are readily assembled and sealed in a precision manner to produce a fixture comparable to fixtures made from components of cast, preformed and/or complex shape.

It is yet another feature of the present invention to provide an improved adjustable reflector system for use in a single housing but capable of accommodating elongated lamps of different sizes, with different arc tube centers without substantial charge to the illumination pattern.

SUMMARY OF THE INVENTION

The preferred embodiment of the housing for the inventive fixture described herein is made from a rectangular metal sheet having four parallel bends therein, all of which are also parallel to the short sides of the rectangle. The dimensions are such that a flexible rectangular reflective sheet curved to be comfortably tangent with respect to the internal surface of the middle three segments of the housing forms a parabolic reflector. Clips or strips are secured to the two outer segments of the housing for holding the reflective sheet in place.

Reflector pieces having suitable tabs for inserting into pre-cut slits in the parabolic reflector and shaped to conform at a pre-determined angle to the internal form created by the parabolic reflector, structurally support the parabolic reflector while increasing the candle power intensity of the light fixture.

Housing end pieces, each containing an internal peripheral groove, are pressed over the opposite exposed edges of the main part of the housing, the grooves also including washers to make the fixture weathertight. The housing ends are secured either by spot welds or by bolting rods.

BRIEF DESCRIPTION OF THE DRAWINGS

So that the manner in which the above-recited features, advantages, and objects of the invention, as well as others which will become apparent, are attained and can be understood in detail, a more particular description of the invention briefly summarized above may be had by reference to the embodiments thereof illustrated in the appended drawings, which form a part of this specification. It is to be noted, however, that the appended drawings illustrate only typical embodiments of the invention and are not to be considered limiting of its scope, for the invention may admit to other equally effective embodiments.

In the Drawings:

FIG. 1 is a pictorial illustration of a preferred embodiment of the invention disclosed herein.

FIG. 3 is a longitudinal side view, in cutaway section, taken along line 3—3 of the embodiment of the invention illustrated in FIG. 1.

FIG. 4 is a pictorial illustration of another preferred embodiment of the invention showing an adjustable side reflector.

DESCRIPTION OF THE PREFERRED EMBODIMENTS

Figure 2:
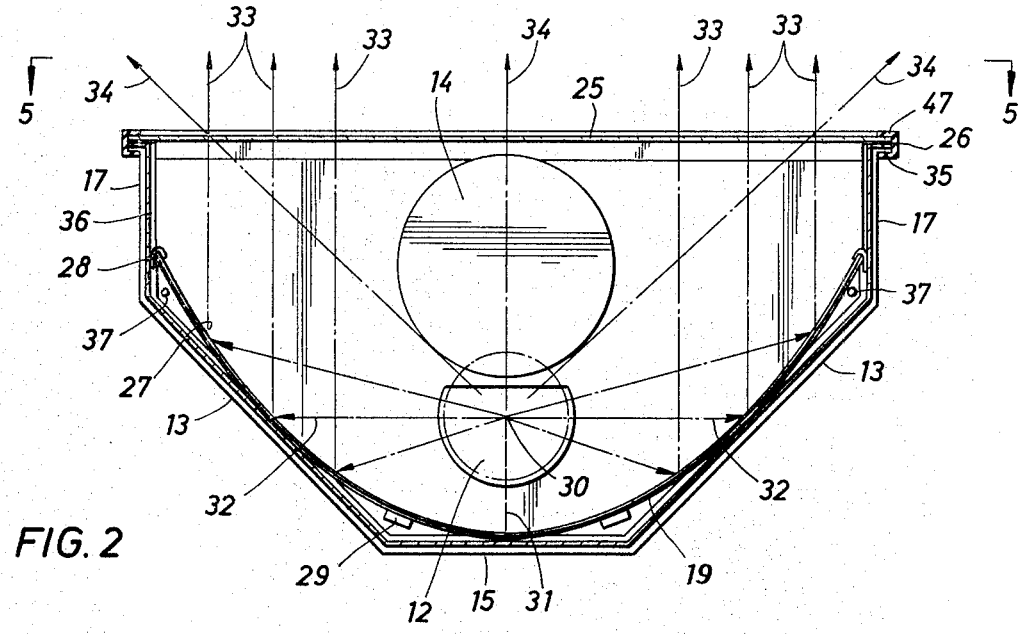
FIG. 2 is a cross sectional view taken at section line 2—2 of the embodiment of the invention illustrated in FIG. 1.

Now referring to the drawings, and first to FIG. 1, an elongated light fixture in accordance with the present invention is illustrated. Elongated lamp 12 is longitudinally positioned to provide direct luminous flux emanating from its longest surface through a frontal opening in housing 11. Lamp 12 is preferably a highly efficient light source such as a high intensity gaseous discharge (HID) lamp. Indirect light reinforcing the intensity of the direct luminous flux is produced by a reflector system located behind lamp 12. Relamp door 14 provides access to lamp 12 for repair or exchange.

Relamp door 14 is preferably weathertight when in the closed position. Door 14 is preferably larger than the corresponding aperture in end wall 39 and is conveniently secured therein by bolting. Sealing is accomplished via a washer (not shown) in the conventional manner.

FIG. 2 is a cross sectional view of the light fixture illustrated in FIG. 1. The inner side walls of the housing are comprised of two planar side walls 13 joined to a planar intermediate wall 15 and angled outward from such intermediate wall at complementary 45 degree angles. Such side and intermediate walls are conveniently and economically made from a continuous rectangular piece of sheet metal by bending such sheet metal in the desired shape. The outer or forward side walls are constructed from the same continuous rectangular piece of sheet metal by further bending the metal an additional 45 degrees. Hence, the two forward sides 17 are at an angle of approximately 90 degrees with respect to intermediate wall 15 providing greater frontal area, the benefit of which, aside from aesthetics, will become apparent. Each bend in the sheet metal is parallel to the other bends and perpendicular to the longitudinal axis of the rectangle. The entire sheet provides a complete wraparound housing for containing the reflector system described below.

Reflector sheet 27 is snapped into place within the housing so that it is tangential to side walls 13 and intermediate wall 15. Sheet 27 is held in place by a plurality of stop means in the form of clips or preferably elongated strips 28 located on forward sides 17. Elongated strips running the whole or partial length of forward sides 17 form stable supports, and are easier to manufacture and install than a plurality of clips.

A highly desirable form of illumination is direct light reinforced by primary indirect light parabolically reflected. A parabolic reflector is defined as a concave mirrored surface which is a paraboloid of revolution and produces parallel rays of light from a source located at the focus of the parabola. To reflect light parabolically, lamp 12 has a focal point 30, and is positioned so that a plane perpendicularly bisecting intermediate side wall 15 also intersects such focal point. The width of intermediate side wall 15 is determined such that with reflector sheet 27 attached to the housing, the length of imaginary perpendicular bisecting plane 31 from focal point 30 to intermediate wall 15 is one-fourth the distance of a second imaginary plane 32 perpendicular to plane 31 stretching between reflector 27 tangential at those points to side walls 13 and passing through focal point 30. The resulting curvature of reflector 27 between the three tangential points creates a parabolic reflector. The desired parabolic reflection characteristics of reflecting primary rays of light that are parallel to each other, can be substantially continued throughout the total length of the reflector 27 by properly placing clips 28 on the forward walls, thereby decreasing the angle of curvature of the reflector with respect to the longitudinal axis of lamp 12.

Forward sides 17 are preferably also covered with reflector sheets 36 or otherwise treated to be reflective. Reflector sheets 36 and reflector sheet 27 may be constructed from specular, brushed, diffused, hammertone, or other conventional reflective material, or any combination thereof. Further, reflector sheet 27 is constructed of a material that is to some degree flexible, such as a sheet of thin metal, to permit curving when longitudinally or latitudinally slightly bent as a whole unit.

A closure lens 25 covers the frontal opening created by the housing and can be of any conventionally used material for lamp lenses such as glass or a multitude of different plastics. The lens is preferably securely affixed to the housing in a manner that precludes undesirable elements of weather from entering the housing and degrading the internal light fixture elements, such as conventionally bolting closure lens 25 to housing 11. A particularly convenient method of attaching plastic closure lenses to the housing is described in patent application Ser. No. 953,271, entitled "Lens Closure for Light Fixture and Method for Attachment", commonly assigned with the present application. The frontally facing ends of the side walls and end walls are bent forming an outwardly projecting flange 35 on the frontal face of the housing. Closure lens 25 can then be united with the flange by a double sided adhesive tape 26, with a metal cored trim 47 covering and securing the unified tape-and-lens structure, if desired.

Reflectors in close proximity to high intensity lamps undergo considerable stress due to constant extreme temperature changes. One or more thin, narrow cushion strips 19 are preferably clipped into place beside each other, behind and in the same manner as reflector 27, supporting reflector 27 in retaining its shape should such reflector anneal. Cushion strips 19 may be constructed from sheets of aluminum alloy or other conventional metals that are producible in thin strips and having a higher temper and more spring than reflector 27.

FIG. 3 is a longitudinal side view, in cutaway section, taken along section line 3—3 of the light fixture illustrated in FIG. 1. Electrical socket 18 is attached to end wall 38. Electrical socket 18 is preferably capable of slight upward tilting movement in the direction of closure lens 25, thereby facilitating reception of an elongated light source such as a standard size HID lamp 12. Most lamps of a given wattage and type are approximately a standard length in the United States. That is, a fixture designed to receive a 400-watt metal halide lamp can fairly certainly receive a replacement metal halide lamp without having to adjust either an end reflective sheet or the fixture components for holding the lamp. End reflector sheet 22 which can be constructed from or covered with specular, brushed, diffused, hammertone, or other conventional reflective material and is preferably attachable to end wall 38 and parabolic reflector 27 illustrated in FIG. 2, reflects light through the window covered by closure lens 25. End reflector sheet 22 is preferably attached so as to make an angle of approximately 68 degrees with the plane of intermediate wall 15, thereby providing efficient outward reflection of light reinforcing the light reflected by parabolic reflector 27. Further, end reflector 22 is preferably shaped so as to tangentially transverse parabolic reflector 27 thereby structurally supporting and maintaining the shape of such parabolic reflector.

Although other methods of connecting end reflector 22 to end wall 38 are well known in the art, one convenient method is by bolting. A particularly convenient method of attaching end reflector 22 to parabolic reflector 27 illustrated in FIG. 2 is providing end reflector 22 with tabs and punching slots in parabolic reflector 27 to accommodate such tabs upon insertion thereinto. End reflector 22 includes an aperture therein for access to lamp 12 so that it can be connected to or removed from electric socket 18.

Light support 16 is adjustably attached, permitting longitudinal movement along longitudinal lamp axis 12, to end wall 39. Although various conventional light supports may be used, illustrated light support 16 preferably has desirable heat insulating and cushioning surfaces arranged in a generally conical pattern as is further described for a preferred embodiment thereof in U.S. Pat. No. 3,781,539. This permits the use of the fixture with various wattage lamps or with lamps of foreign manufacture.

A second end reflector 24, is attached to end wall 39 in the same manner as end reflector 22 is attached to end wall 38. End reflector 24 is preferably attachable to parabolic reflector 27 by the same above-identified system of tabs and slots at approximately a 68 degree angle with the plane of intermediate wall 15. End reflector 24 also has a first aperture sufficiently large to accommodate either the non-electrical end portion of lamp 12 as it is joined with adjusted light support 16, or the end of light support 16 when extended to join with a smaller lamp. Relamp door 14 is attached via connecting bar 23 to a removable portion 40 of end reflector 24. Thus, removal of relamp door 14 permits access to lamp 12.

It should also be noted that by using a series of reflectors tending in part to reinforce each other and whose reflective surfaces and reflecting capabilities can be varied, the beam candle power distribution can be varied without actually changing the shape of the reflector.

FIG. 4 illustrates a similar view of the invention as FIG. 3, including in another preferred embodiment, an adjustable end reflector. Elongated light sources of different lengths, such as radium, Osram, or Mazda lamps, also have arc tubes of different lengths. One such light source is depicted by lamp 41. To provide a uniform power distrubution beam the center of the arc tube should be substantially equidistant between the end reflectors. End reflector 42 is similar to end reflector 22 of FIG. 3, in that its construction includes an aperture proximate to electric socket 18, thereby permitting lamp 41 to be connected thereinto. Tabs 29 provide means for securing end reflector 42 into slots in parabolic reflector 27. When in place, end reflector 42 preferably is substantially at a 68 degree angle with intermediate wall 15. However, extension piece 43 is added to end reflector 22 proximately and is substantially parallel to closure lens 25. The overall length of the lamp and the arc length of the lamp dictate the size of extension piece 43. Extension piece 43 preferably has lip 44 bent downwardly substantially parallel to end wall 38. Lip 44 is secured to end wall 38 such as by bolting lip 44 to end wall 38, although other suitable means could be employed.

Figure 5:
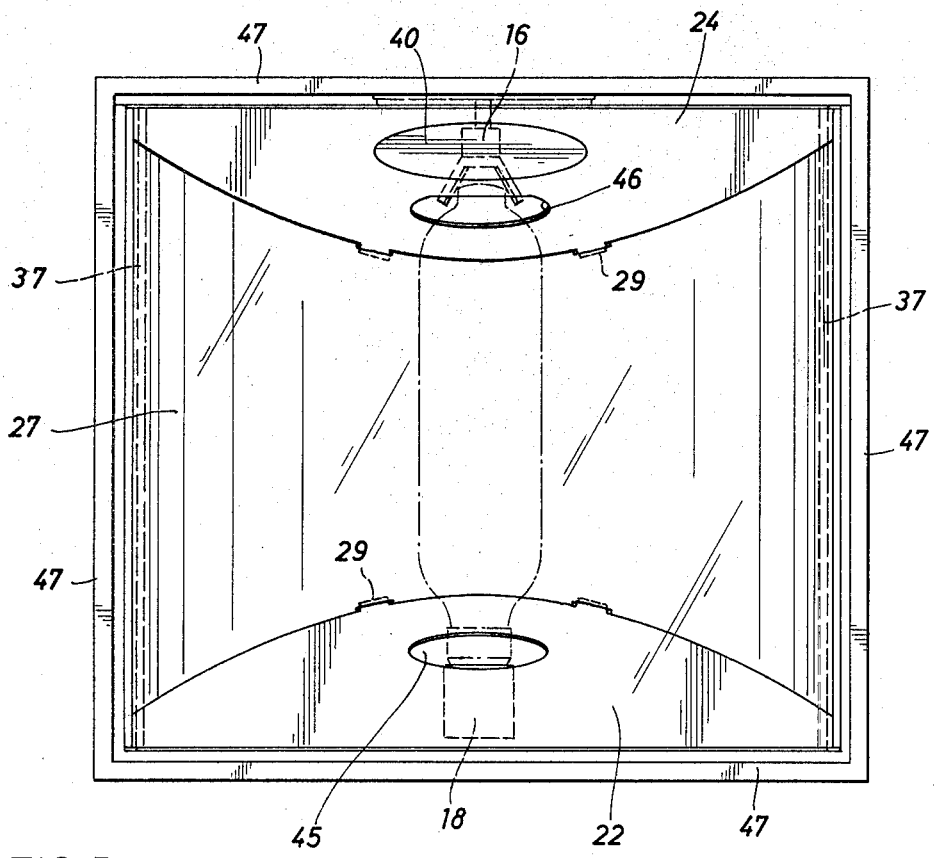
FIG. 5 is a frontal view taken at section line 5—5 of the embodiment of the invention illustrated in FIG. 2.

FIG. 5 illustrates bolting rods 37 that run the length of the housing between reflector 27 and the side walls of the housing and are attached to end wall 38 and end wall 39, thereby securing such end walls to the side walls forming the housing. End wall 38 and end wall 39 preferably have peripheral grooves (not shown) to facilitate connection onto the ends of the walls formed in the wraparound sheet. Washers are preferably used in the grooves to assist in making the connection weathertight. An alternative method of attachment would be to spot weld the end walls to the side walls of the housing.

It may be observed that a reflector sheet of proper dimension clipped in place in a manner similar to parabolic reflector 27 herein described, could assume a parabolic shape even though it might not be tangential to some or all of the described side walls, intermediate wall, and reflector sheets. Such a non-supported relfector sheet would be subject to external pressures, especially heat and cold expansion forces, tending to warp the reflector. The support effected by the end reflector sheets and the side and intermediate walls as reinforced by the resilient pressures exerted by the cushion strips, improved the life and consistency of the parabolic reflector.

While particular embodiments of the invention have been shown and described, it will be understood that the invention is not limited thereto, since many modifications may be made and will be apparent to those skilled in the art. For example, the lens closure can be bolted to the housing or attached by any other means permitting relatively easy access for relamping, eliminating the need for a relamp door, if desired.

I claim:

1. A lighting fixture for mounting therein a lamp having an elongate axis, comprising a housing at least partially surrounding the elongate axis of the lamp so as to leave an opening on one side thereof for light emanations, said housing having a plurality of internal planar side walls, first reflector position stop means connected to one of said internal housing side wall, second reflector position stop means connected to another of said internal housing side walls, and a flexible reflector sheet having a first edge held in position by said first reflector position stop means, and a second edge held in position by said second reflector position stop means, the shape of said reflector sheet being determined by the points of contact said sheet makes with said internal planar side walls between said first and second stop means.

2. A lighting fixture in accordance with claim 1 wherein the shape of said reflector sheet is also determined by the points of contact said sheet makes with another of said internal planar side walls between said first and second stop means.

3. A lighting fixture in accordance with claim 1, wherein at least one of said first and second reflector position stop means includes at least one clip secured to an internal housing side wall having a receiving groove for accepting an elongate edge of said sheet.

4. A lighting fixture in accordance with claim 3, wherein said clip is an elongate strip.

5. A lighting fixture in accordance with claim 1, wherein said plurality of internal side walls includes a first wall on the side of said housing opposite said opening substantially parallel to said lamp axis, a second wall joined along a line substantially parallel to said lamp axis at a predetermined angle to one side of said first wall, and a third wall joined along a line substantially parallel to said lamp axis at the same predetermined angle to the other side of said first wall, the shape of said reflector sheet being determined by at least the points of contact thereof with said second and third walls.

6. A lighting fixture in accordance with claim 5, wherein said predetermined angle is 45 degrees and the normal distance between said lamp axis and said first wall is at least one-half of the distance from said lamp axis along a line at a right angle to said second wall in one direction and also at least one-half of the distance to said third wall in the other direction, said reflector sheet contacting said second and third walls so as to assume a substantially parabolic reflector shape with respect to said lamp.

7. A lighting fixture in accordance with claim 1, and including at least one end reflector cutting across said lamp axis for radiating light from said lamp forward through said opening, said reflector joining said reflector sheet in a curvilinear line substantially perpendicular to said lamp axis.

8. A lighting fixture in accordance with claim 7 wherein said end reflector is planar, the plane of said reflector being at an angle of approximately 68 degrees with respect to said lamp axis.

9. A lighting fixture in accordance with claim 1, wherein said flexible sheet includes position slits and said end reflector includes mating tabs for providing positioning and securing of said end reflector.

10. A lighting fixture in accordance with claim 1, wherein said internal side walls are made from a continuous sheet bent to form the joining lines between said walls.

11. A lighting fixture in accordance with claim 10, and including end pieces for said housing including mounting and sealing grooves for accepting the edge of said side walls therein.

12. A lighting fixture in accordance with claim 11, wherein at least one of said end pieces includes an entry door for access to said lamp.

13. A lighting fixture in accordance with claim 12, wherein said door includes a piece in said end reflector.

14. A lighting fixture in accordance with claim 1, and including holding means for supporting the end of a lamp not connected into a socket to maintain its axial alignment.

15. A lighting fixture in accordance with claim 1, and including end reflectors cutting across said lamp axis at opposite ends of said lamp for radiating light from said lamp forward through said opening, said reflectors joining said reflector sheet in respective curvilinear lines, means for attaching one of said end reflectors in at least two parallel positions spaced apart from the other of said end reflectors within said housing for accommodating lamps of variable lengths.

16. A lighting fixture in accordance with claim 1, and including at least one strip of a flexible metal sheet of higher temper than and substantially the same length as said reflector sheet, placed between said reflector sheet and said housing, and held in place by said first and second stop means.

17. A lighting fixture in accordance with claim 16, wherein said strip of flexible metal sheet is aluminum alloy.

18. The process of manufacturing a light reflector system including a parabolic reflector for a lamp mounted therein, which comprises forming a housing for the light reflector having planar first and second side walls angled inwardly from the opening of the reflector at complementary 45 degree angles, and at least one intermediate wall therebetween joining said first and second side walls on the side of the lamp opposite the opening, the distance along a line perpendicular to and through the axis of the lamp to said first and second side walls being at least four times the distance as the normal distance from the axis of the lamp to said intermediate wall, connecting stop means above and outwardly of the points on said side walls to which the perpendicular is measured, and forming a flexible reflecting sheet into an arc, opposite edges thereof being retained by said first and second stop means, said arc being tangent to said side walls and extending to a distance from said lamp axis of one-fourth the linear distance between the points.

19. The process of manufacturing a light reflector system in accordance with claim 18, wherein said intermediate wall is located at a distance normal to the lamp axis which is one-fourth of the distance between said points so that said arc is also tangent to said intermediate wall.

20. The process of manufacturing a light reflector system in accordance with claim 18, and including the step of positioning at least one planar end reflector inwardly angled from said opening to cut across the lamp axis at an angle of approximately 68 degrees and so as to intersect the arcuate reflecting sheet in a curvilinear line perpendicular to said lamp axis.

21. The process of manufacturing a light reflector system in accordance with claim 18, and including the step of closing the housing on at least one end with a planar end piece having a groove in the periphery thereof for receiving the edges of said housing walls.

22. The process of manufacturing a light reflector system in accordance with claim 18, and including the step of forming at least one strip of a flexible metal sheet of a higher temper and more resiliency than said reflecting sheet into an arc, opposite edges thereof being retained by said first and second stop means, said arc being tangent to and between said side walls and said reflecting sheet.

* * * * *